US009548552B2

(12) United States Patent
Aboulkassem et al.

(10) Patent No.: US 9,548,552 B2
(45) Date of Patent: Jan. 17, 2017

(54) PLUG CONTACT MODULES AND PLUG CONTACT ARRANGEMENT FOR TRANSMITTING FREQUENCIES IN THE GIGAHERTZ RANGE

(71) Applicant: Tyco Electronics AMP GmbH, Bensheim (DE)

(72) Inventors: Mohamed Aboulkassem, Griesheim (DE); Bert Bergner, Bensheim (DE); Rudolf Kraemer, Lautertal-Beedenkirchen (DE); Christian Schrettlinger, Bensheim-Auerbach (DE); Konstantin Zech, Leimen (DE); Sabine Hass, Erzhausen (DE)

(73) Assignee: TE Connectivity Germany GmbH, Bensheim (DE)

( * ) Notice: Subject to any disclaimer, the term of this patent is extended or adjusted under 35 U.S.C. 154(b) by 324 days.

(21) Appl. No.: 14/079,207

(22) Filed: Nov. 13, 2013

(65) Prior Publication Data

US 2014/0065899 A1 Mar. 6, 2014

Related U.S. Application Data

(63) Continuation of application No. PCT/EP2012/058098, filed on May 3, 2012.

(30) Foreign Application Priority Data

May 13, 2011 (DE) ..... 10 2011 050 364

(51) Int. Cl.
*H01R 13/04* (2006.01)
*H01R 12/72* (2011.01)
(Continued)

(52) U.S. Cl.
CPC ..... *H01R 13/04* (2013.01); *H01R 12/721* (2013.01); *H01R 13/055* (2013.01); *H01R 13/113* (2013.01)

(58) Field of Classification Search
CPC ..... H01R 13/28; H01R 13/15
(Continued)

(56) References Cited

U.S. PATENT DOCUMENTS 5,716,241 A 2/1998 Hennemann et al.
6,033,264 A 3/2000 Feye-Hohmann
(Continued)

FOREIGN PATENT DOCUMENTS

DE 19826390 A1 12/1999
EP 1173902 B1 3/2003
(Continued)

OTHER PUBLICATIONS

PCT Search Report for International Application No. PCT/EP2012/058098, issued Jul. 5, 2012, 5 pages.
(Continued)

*Primary Examiner* — Briggitte R Hammond
(74) *Attorney, Agent, or Firm* — Barley Snyder

(57) ABSTRACT

A plug contact arrangement is provided having a plurality of plug contact modules, including a plug socket module and a plug contact module. The plug socket module includes a base member and a socket contact section connected to the base member and having pair of contact members extending linearly and parallel with respect to each other and defining a contact blade receiving member there between. Each of the pair of contact members includes a contact face extending into the contact blade receiving member. The plug contact module is securable to the plug socket module and includes a plurality of lateral walls extending parallel to each other, a reinforcement member connecting the plurality of lateral
(Continued)

walls, and a contact section extending from the plurality of lateral walls and having a contact blade having opposite contact faces to engage the pair of contact members.

16 Claims, 5 Drawing Sheets

(51) Int. Cl.
*H01R 13/05* (2006.01)
*H01R 13/11* (2006.01)

(58) Field of Classification Search
USPC ..... 439/290, 891, 289
See application file for complete search history.

(56) References Cited

U.S. PATENT DOCUMENTS 6,183,269 B1 2/2001 Sarkissian et al.
6,319,075 B1 * 11/2001 Clark ..... H01R 13/11 439/825
7,976,317 B2 * 7/2011 Patel ..... H01R 12/7088 439/79
7,976,319 B2 7/2011 Nguyen et al.
2001/0034165 A1 10/2001 Landis et al.
2003/0181106 A1 * 9/2003 Schell ..... H01R 13/055 439/825

FOREIGN PATENT DOCUMENTS

WO 2009073695 A1 6/2009
WO 2011/070042 A1 6/2011

OTHER PUBLICATIONS

PCT International Preliminary Report with Written Opinion for International Application No. PCT/EP2012/058098, issued Nov. 28, 2013, 9 pages.
English translation of Chinese Office Action, dated Jul. 27, 2015, 11 pages.

* cited by examiner

PLUG CONTACT MODULES AND PLUG CONTACT ARRANGEMENT FOR TRANSMITTING FREQUENCIES IN THE GIGAHERTZ RANGE

CROSS-REFERENCE TO RELATED APPLICATIONS

This application is a continuation of PCT International Application No. PCT/EP2012/058098 filed May 3, 2012, which claims priority under 35 U.S.C. §119 to German Patent Application No. 10 2011 050 364.1 filed May 13, 2011.

FIELD OF INVENTION

The present invention relates to a plug contact module and, in particular, to a plug contact module for use with an industrial input/output module.

BACKGROUND

Known industrial input/output modules are described, for example, in DE4402002 A1, EP1173902 B1 and US 2001/034165 A1. These known industrial input/output modules are generally mounted on a carrier rail and can be combined using their lateral faces. A guiding and retention device is positioned along a lateral face. Contacts are arranged along the lateral faces so that they are accessible from the outer side and serve to supply electrical power and data transmission. When urged together, contacts become automatically connected to the contacts of the adjacent module. Since these known modules are often roughly handled, the plug connections must be robust and also allow reliable contacting under adverse environmental conditions.

FIG. 7 of EP1173902 B1 shows a known plug contact module having two contact members which together restrict a contact blade receiving member. The contact blade receiving member is arranged along a lateral wall of the known input/output module in order to be accessible from an outer side. An additional known plug contact module with contact blades is positioned along an opposing lateral wall, with the contact blades arranged to be accessible from the outer side. When connecting the two known modules along their lateral faces, in the direction towards the carrier rail, the contact blades automatically move into the contact blade receiving member and produce an electrical connection with the contact members of the other plug contact module. In this manner, data can flow between adjacent known input/output modules connected to each other.

Practice has shown that the known plug contact modules described in EP1173902 B1 in the form of socket and blade contacts do not meet the requirements for a loss-free transmission with the currently required high data rates in the range of several gigabits per second.

SUMMARY

In view of the of the above described problems, an object of the invention, among others, is to improve plug contact arrangements having a plurality of plug modules providing frequencies in the gigahertz range that can be transmitted without any losses in terms of robustness.

Accordingly, a plug contact arrangement is provided with a plurality of plug contact modules, including a plug socket module and a plug contact module. The plug socket module includes a base member and a socket contact section connected to the base member and having pair of contact members extending linearly and parallel with respect to each other and defining a contact blade receiving member there between. Each of the pair of contact members includes a contact face extending into the contact blade receiving member. The plug contact module is securable to the plug socket module and includes a plurality of lateral walls extending parallel to each other, a reinforcement member connecting the plurality of lateral walls, and a contact section extending from the plurality of lateral walls and having a contact blade having opposite contact faces to engage the pair of contact members.

BRIEF DESCRIPTION OF THE DRAWINGS

The invention is explained in greater detail below by way of example with reference to the appended drawings of which.

DETAILED DESCRIPTION OF THE EMBODIMENTS

In the following, a connector having a plug contact module according to the invention will be described with reference to the attached drawings.

Figure 2:
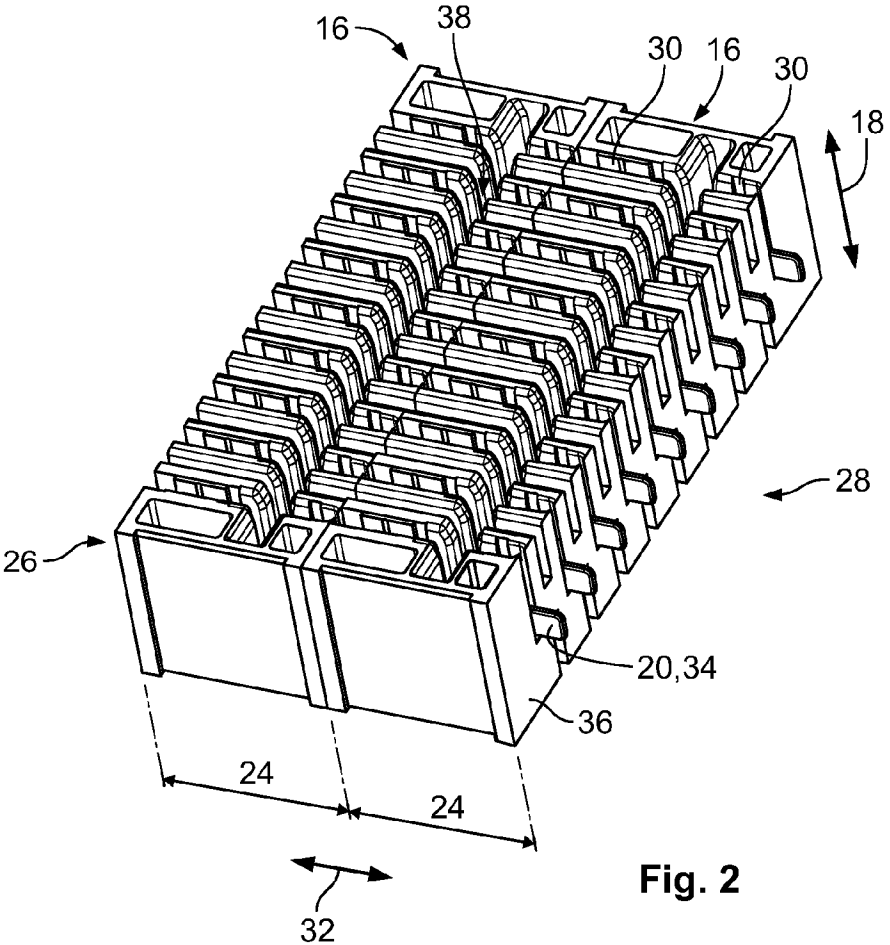
FIG. 2 is a perspective view of plug connectors having the plug contact module according to the invention when used in the industrial input/output modules of FIG. 1.
Figure 1:
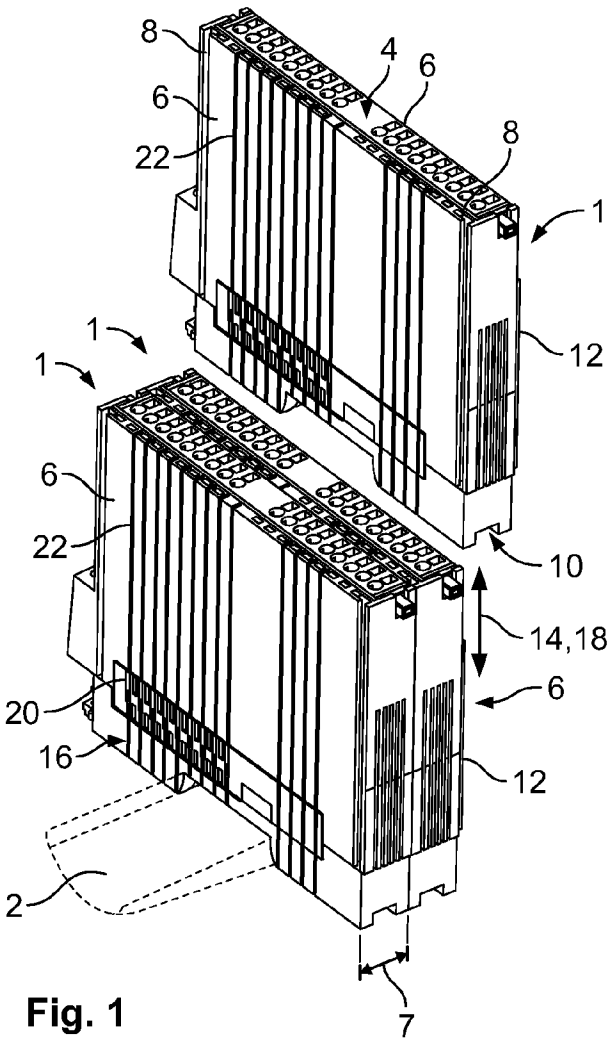
FIG. 1 is a perspective view of an industrial input/output modules having a plug contact module according to the invention.

With reference to FIGS. 1 and 2, input/output modules 1 for use with plug contact modules according to the invention are shown to be fitted beside each other along a carrier rail 2. Depending on the function, the industrial input/output modules 1 are provided with line connections and/or operating elements, along their front sides 4 respectively, which face away from the carrier rail 2.

The input/output modules 1 can be arranged directly beside each other on the carrier rail 2 so that their connecting sides 6 are directly in abutment. Each input/output modules 1 can be mutually replaced, the depths 7 thereof are generally standardised with modular dimensions in the longitudinal direction of the carrier rail 2. The input/output modules 1 include receiving lock sections 8, such as, for example, undercut grooves which extend from the front side 4 to a rear side 10 which faces towards the carrier rail 2. Projecting lock sections 12 which are constructed accordingly in a complementary manner in the form of, for example, undercut ribs of the other connecting side 6 in each case, move into the receiving lock sections 8 and guide the input/output modules 1 in a movement direction 14, in this instance perpendicularly relative to the front side 4.

Integrated plug connectors 16 are provided along the connecting sides 6, so that when the input/output modules 1 are pushed together in the movement direction 14, they automatically produce contact with respect to a correspondingly complementary plug connector 16 on the opposite connecting side of the adjacent input/output module 1. Generally, each input/output module 1 is provided with a complementary plug connector 16 at each of the two connecting sides 6 thereof, so that in the case of adjacent input/output modules, mutually fitting plug connectors always automatically face each other. Accordingly, data may be exchanged between the input/output modules 1 using a plurality of interposed input/output modules 1 using the plug connectors 16.

The plug connectors 16 are connected to each other along an movement direction 18 that extends perpendicularly relative to a signal path (not illustrated in FIG. 1), which extends from contact sections 20 of the plug connectors 16 that are accessible from the outer side in a substantially perpendicular manner relative to the connecting side 6 into the inner side of the input/output module 1 and from there to the plug connector 16 at the other connecting side 6.

At least one connecting side is provided with receiving grooves 22 which extend in a displacement or movement direction 14, 18 to a contact section 20 continuously over the entire connecting side 6. The receiving grooves 22 are provided so that the contact sections 20 of opposing connecting sides can be brought into contact with each other. When two input/output modules are connected, the contact sections (not shown in FIG. 1) of one plug connector are inserted into the receiving grooves 22 and move therein in a displacement or movement direction 14, 18 until they come into contact with the contact sections of the complementary plug connector 16.

FIG. 2 shows two plug connectors 16 connected to each other, as produced, for example, with the connected input/output modules 1 shown on the left-hand side in FIG. 1. The input/output modules 1 with their components are omitted in order to open up the view of the plug connectors. The depth 24 of the plug connectors 16 may correspond to the depth 7 of the input/output modules 1 so that the mutually complementary plug faces 26, 28 of the plug connectors 16 come to rest in each case on a connecting side 6 of an input/output module at the outer side. The plug connectors 16 are provided with a plurality of adjacent module receiving members 30 which each extend transversely relative to the plug faces 26, 28 in the depth direction 32 and open towards the plug faces 26, 28 so that the contact sections 20 are accessible from the outer side.

In FIG. 2, the contact sections 20 are provided along one plug face 28, and constructed in the form of contact blades 34, which protrude with respect to a lateral face 36 of the plug face. When a plurality of input/output modules 1 are connected, the contact blades 34 are provided into the receiving grooves 22 (see FIG. 1). Transversely over a plurality of module receiving members 30, the plug connector 16 as shown in FIG. 2 may also provide a circuit board receiving member 38 for a printed circuit board.

The plug connectors 16 are, as described below, particularly constructed to transmit data with high data rates in the range of several gigabits per second corresponding to signal frequencies in the gigahertz range.

Figure 3:
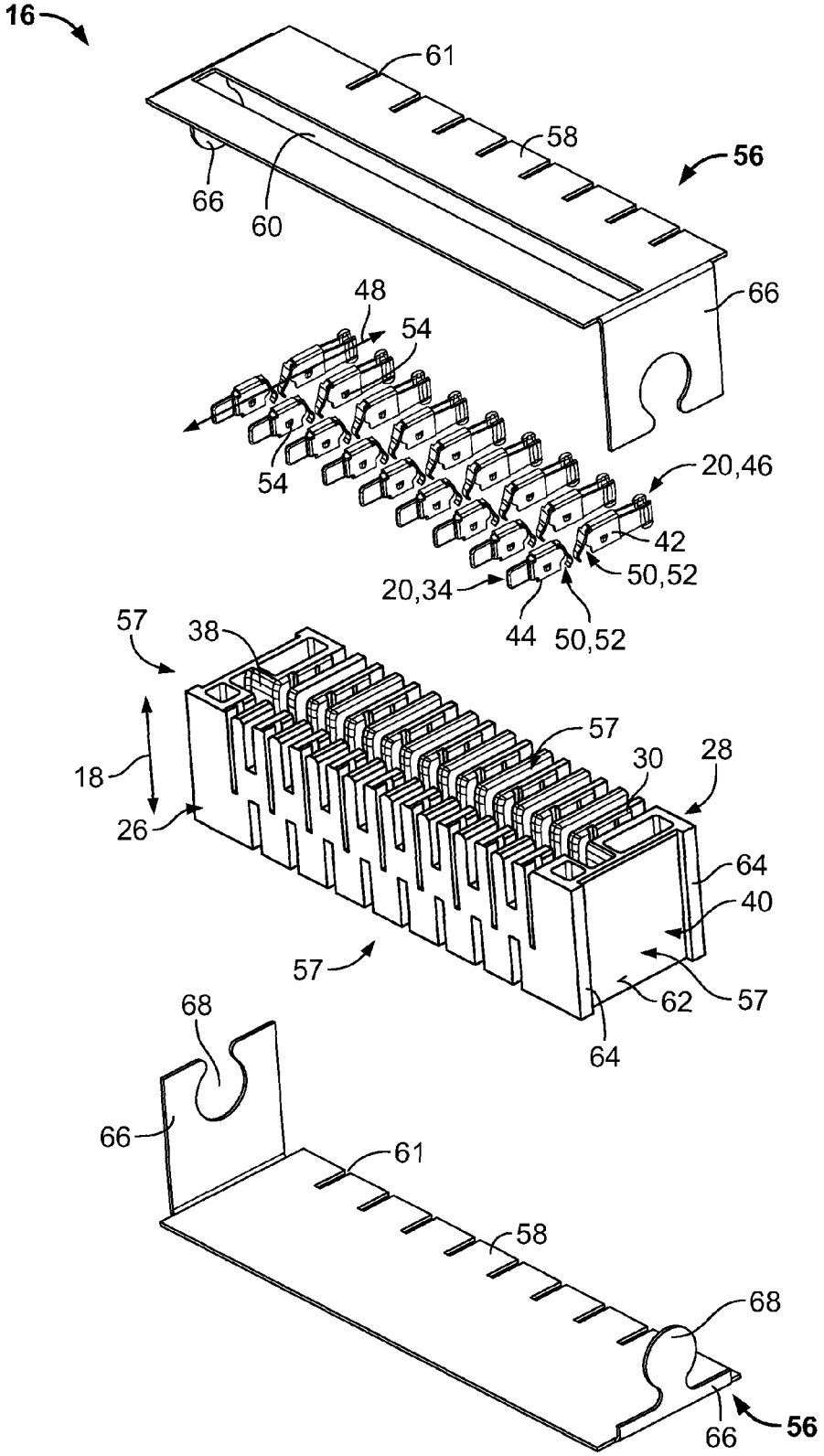
FIG. 3 is an exploded perspective view of one of the plug connectors of FIG. 2 having additional shielding plates.

With reference to FIG. 3, the plug connector 16 includes, for example, a base member 40 of an electrically insulating material, such as a plastic material which is capable of being injection-molded. In the shown embodiment, the base member 40 is parallelepipedal shaped. The module receiving members 30 and the printed circuit board receiving member 38 may be formed in the base member 40.

A plurality of plug contact modules 42, 44 are provided in the module receiving members 30, which form the mutually complementary contact sections 20 on the opposite plug faces 26, 28, respectively. In the shown embodiment, the contact section 20 of one plug contact module 42 is constructed as a socket contact 46. The contact section 20 of the other complementary plug contact module 44 has, as a contact section, a contact blade 34 which is constructed to received into the socket contact 46.

In the shown embodiment, the plug contact modules 42, 44 are produced from a curved metal sheet which is stamped and formed into an appropriate shape.

A signal path 48 extends substantially from the contact section 20 of one plug contact module 42 to the contact section 20 of the other complementary plug contact module 44 of the same plug connector 16. If a printed circuit board is arranged in the printed circuit board receiving member 38, the signals may be guided in the region between the plug contact modules 42, 44 using the printed circuit board. The movement direction 18 extends perpendicularly relative to the signal path 48. A printed circuit board may be arranged in the signal path 48.

In order to contact a printed circuit board (not illustrated in FIG. 3) which is inserted into the printed circuit board receiving member 38, the plug contact modules 42, 44 are provided with a printed circuit board contact section 50, at the end opposite the contact section 20 of each plug contact module 42, 44 with respect to the signal path 48. The plug contact modules 42, 44 may be provided with securing elements 54 in the form of stamped or otherwise formed positive-locking or frictionally engaging elements, such as, for example, catch projections or clamping springs.

For shielding, the plug connector 16 may be provided with a shield 56, for example, in the form of two shielding plates 58 which together form a frame and which can be positioned around the lateral faces 57 of the plug connector 16 that adjoin the plug faces 26, 28. At least one shielding plate 58 may be provided with a slot-like recess 60 at the location corresponding to the printed circuit board receiving member 38 of the base member 40, so that printed circuit boards can be inserted through the shield 56 into the plug connector 16. The shield may further be provided with recesses 61 which open towards the edge at least at the side of the socket contacts 46 so that, when a plurality of plug connectors 16 are connected in the movement direction 18, the contact blades 34 can pass the shield 56. When the plug connectors 16 are assembled, the recesses 61 are in alignment with the receiving grooves 22 of the input/output modules 1 (see also FIG. 1).

Retention webs 64 may be provided between and extend parallel with the plug faces 26. The narrow-sided portions 66 of the shielding plates 58 can be inserted between the retention webs 64. The narrow-sided portions 66 are hooked one inside the other at the narrow sides 62 using complementary positive-locking elements 68 so that the shield 56 can be secured to the base member 40 by means of positive-locking alone.

Figure 4:
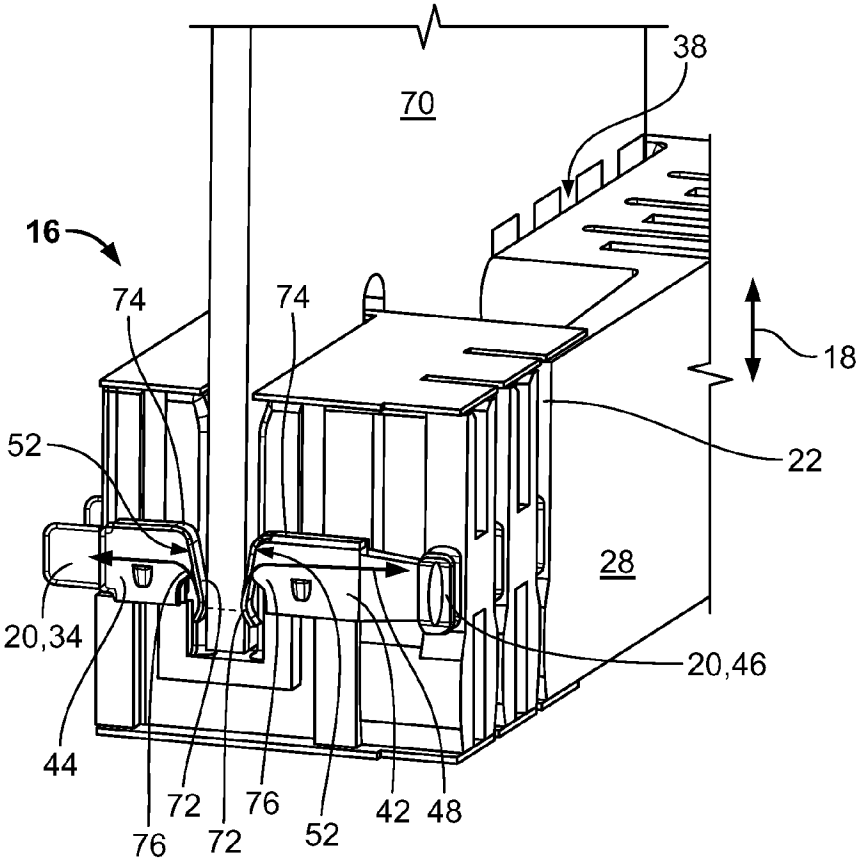
FIG. 4 is a sectional view of a plug connector having a plug contact module according to the invention when a printed circuit board is inserted there into.

Now with reference to FIG. 4, a printed circuit board 70 is shown which is inserted into the printed circuit board receiving member 38. It can be seen that the otherwise identically constructed printed circuit board contact sections 52 of the complementary plug contact modules 42, 44 are provided with a printed circuit board contact spring 72. By the printed circuit board 70 being inserted, the printed circuit board contact springs 72 are redirected in the direction of the contact sections 20 until their halves facing an articulation section 74 abut a stop 76 of the respective plug contact module 42, 44. Since the half of the printed circuit board contact spring 72 remote from the respective articulation section 74 remains free, the abutment thereof against the stop 76 increases the resilient rigidity, but not movability thereof. Consequently, an electrically conductive contact is achieved with the printed circuit board contact spring 72 not only by means of the articulation section 74, but also by means of the stop 76.

In order to optimise signal transmission between the plug contact modules 42, 44 and the printed circuit board 70, structural measures are carried out in particular at the side of the printed circuit board, for example, by means of a stripline design.

In the embodiment shown in FIG. 4, the signal path 48 extends in the region between the plug contact modules 42, 44 over the printed circuit boards 70, which is indicated by the short dashes of the signal path in this portion in FIG. 4.

It is further shown in FIG. 4 that the socket contacts 46 are recessed in the plug face 28. In order to contact the socket contacts 46, it is consequently necessary for the contact blades 34 to be inserted into the receiving grooves 22 which are in alignment with the socket contacts 46 in the movement direction 18.

Figure 5:
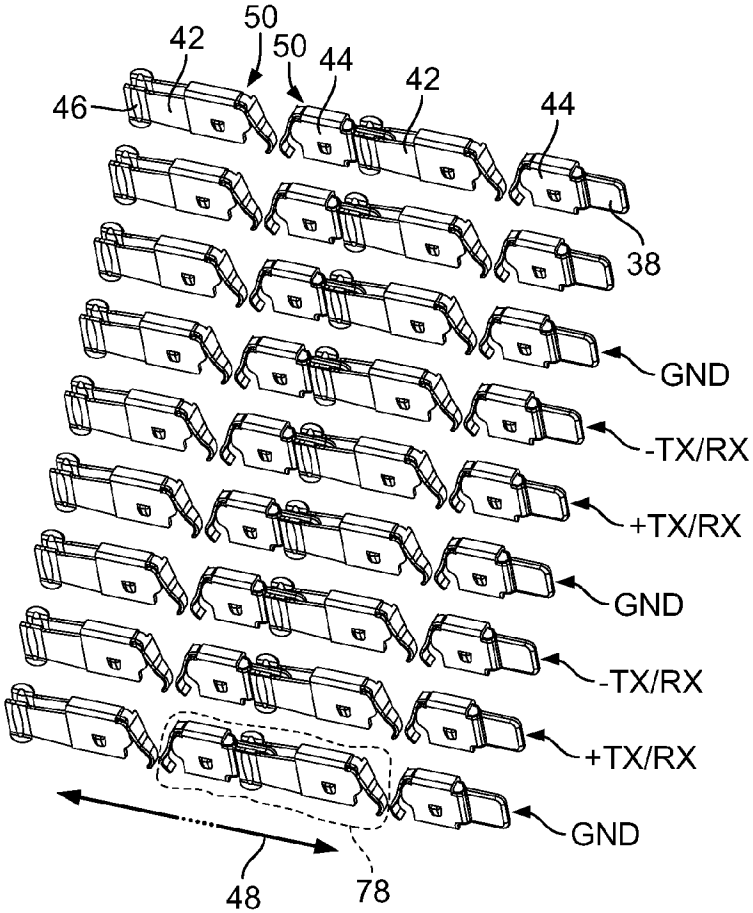
FIG. 5 is a perspective view of a plurality of plug contact modules according to the invention.

If, as shown in FIG. 2, a plurality of plug connectors 16 are laterally connected, the arrangement of plug contact modules 44, 42, as shown in FIG. 5, is produced along the signal path 18.

Now with reference to FIG. 5, the printed circuit board 70 and the shield 56 with the base member 40 are omitted in order to open up the view of the plug contact modules 42, 44. As shown, the contact blades 34 extend into the socket contacts 46. In the region of the printed circuit board contact sections 52, the signal path 48 is again shown with broken lines in FIG. 5 since the signals can extend using a printed circuit board (not shown).

Two plug contact modules 42, 44 which are constructed so as to be able to be laterally connected form a plug contact arrangement 78.

In addition to the structural measures for transmitting frequencies in the gigahertz range using a plug contact arrangement 78 along the signal path 48, an improvement of the signal quality can also be achieved by the positioning of plug contact arrangements 78, which are located beside each other. It is thus possible to separate a plurality of independent pairs of differential channels +TX/RX and −TX/RX in each case by means of ground pins GND in order to increase the crosstalk attenuation and to be able to better control the impedance. This is advantageous, particularly in connection with a shield 56.

Figure 7:
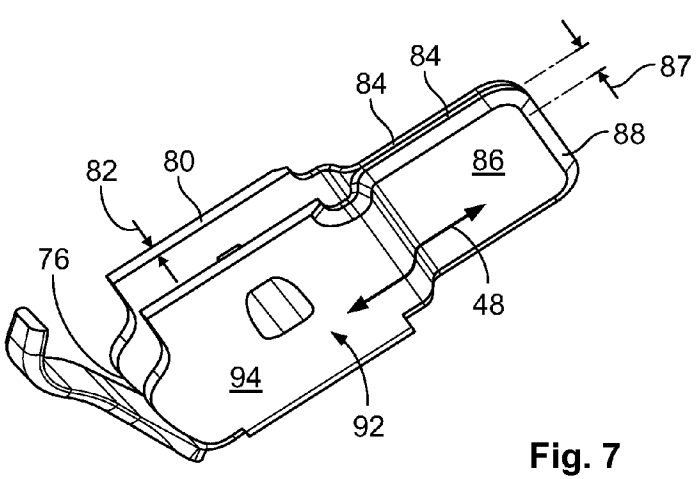
FIG. 7 is another perspective view of the plug contact module of FIG. 6.
Figure 6:
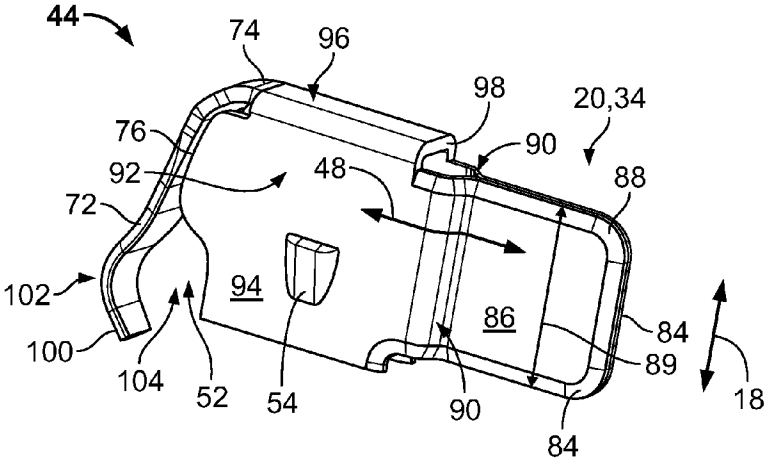
FIG. 6 is a perspective view of a plug contact module according to the invention having a blade contact.

Now with reference to FIGS. 6 and 7, a plug contact module 44 is now described whose contact section 20 is provided with a substantially plate-like or disc-like contact blade 34. The plug contact module 44 is prepared from punched and folded or tacked metal sheet 80 of constant material thickness 82. In the region of the contact blade 34, two layers 84 are connected over the whole surface and at the connecting sides thereof, each layer 84 forming at its outer side a flat contact face 86. The material thickness 87 of the contact blade 34 is consequently twice as great as the material thickness 82 of the metal sheet 80.

The contact blade 34 is provided at the edges at both sides with a chamfer 88, which extends away from the contact faces 86 over at least half of the material thickness 82 of a layer 84. The height of the contact blade 34, measured between two free edges and transversely relative to the signal path 48, in FIG. 6 parallel with the movement direction, is given the reference numeral 89.

The contact faces 86 each terminate at a shoulder 90, at which the plug contact module 44 is expanded with respect to the contact blade 34. The layers 84 continue beyond the shoulders 90 in an extension section 92, in which the layers 84 are spaced further apart than in the contact blade 34. In the extension section 92, the layers 84 extend as in the contact blade 34 in a linear manner and parallel with each other. A modification of the path of the layers 84 in the direction of the signal path 48 takes place only in the region of the shoulders 90.

The layers 84 of the metal sheet 80 form two mutually parallel lateral walls 94 along the extension section 92. For reinforcement, the two lateral walls 94 are connected to each other at a narrow side 96 of the plug contact module 44 using a curved reinforcement member 98, which extends over the entire length of the extension section. As shown in FIG. 6, an articulation section 74 for the printed circuit board contact spring 72 may be arranged at the end of the curved reinforcement member 98 opposite the contact section. The curved reinforcement member 98 consequently continues as a printed circuit board contact spring 72.

The lateral walls 94 extend towards the printed circuit board contact spring 72 and form the stop 76 which is constructed in the direction of the printed circuit board contact spring in such a manner that the spring fits tightly in a planar manner when deflected. The stop 76 is arranged in the region of the first half of the printed circuit board contact spring 72 so that the second half with the free end 100 remains movable in the direction towards the contact section 20. In the region of the free end 100, the printed circuit board contact spring 72 is provided with a curved section 102 which is directed away from the contact section 20. Opposite the free end 100, with the curved section 102, the stop 76 does not continue so that a recess 104 is formed by the lateral walls 94 of the extension section. The free end 100 with the curved section 102 can still be deflected in the direction towards the contact section 20 when the region located closer to the articulation section 74 is already in abutment against the stop 76.

Figure 9:
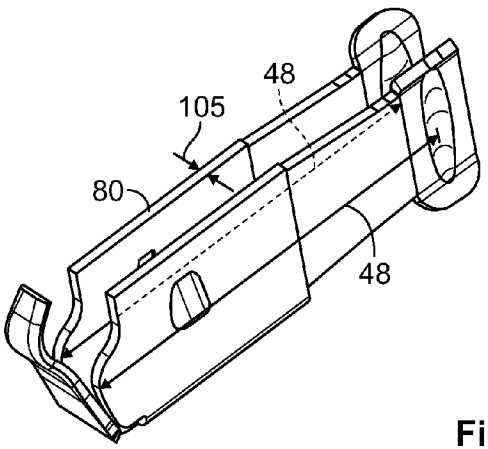
FIG. 9 is another perspective view of the plug contact module of FIG. 8.
Figure 8:
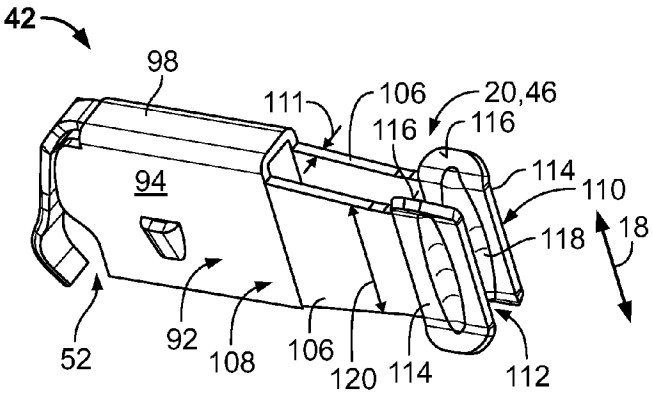
FIG. 8 is a perspective view of another plug contact module according to the invention, having a socket contact.

In FIGS. 8 and 9, a plug contact module 42 having a contact section 20 which is constructed as a socket contact 46 is shown. The plug contact module 42 is, in the same manner as the plug contact module 44, produced from a metal sheet 80 with a material thickness 105. The material thickness 105 of the metal sheet of the plug contact module 42 corresponds to the material thickness 82 of the plug contact module 44.

The printed circuit board contact section 52 is positioned at the end of the plug contact module 42 opposite the contact section 20 and which is constructed in a substantially identical manner to the printed circuit board contact section 52. With regard to the function and configuration of the stop 76 and the printed circuit board contact spring 72 and the recess 104, reference is consequently made for the sake of brevity to the explanations relating to FIGS. 6 and 7.

As shown, the contact section 20 of the plug contact module 42 includes two contact members 106 which each extend from a member base 108 to a free end 110 in a linear manner. The contact members 106 delimit a contact blade receiving member 112 at both sides in the direction transverse relative to the movement direction 18. The contact members 106 have a material thickness 111 which is equal to the material thickness 105 in the entire plug contact module 42.

The plug contacts 106 include contact plates whose portions which are extended in the movement direction 18 and which protrude beyond the contact springs 72 are inclined relative to the contact springs 72 and extend towards each other in the direction of the contact springs 72. Receiving edges 116 which facilitate the insertion of a contact blade 34 in the movement direction into the contact blade receiving member 112 are thereby produced.

The contact plates may be provided with a contact face 118 which is curved inward toward the blade contact receiving member 112 and which extends over at least the entire height 120 of the contact springs 72 and extends parallel with the movement direction 18. The curved contact face 118 is curved at least over the entire height 120 in a barrel-like manner so that, with a flat contact face 86 of a contact blade 34, at least linear contact is produced over the height 120 of a contact member.

In the direction towards the printed circuit board contact section 52, the contact members 106 continue in an extension section 92, in which they are connected to each other by means of the curved reinforcement member 98. The curved reinforcement member 98 leads to the extension section having greater rigidity than the contact members 106 which can be redirected transversely relative to the movement direction 18. When viewed from the contact blade receiving member 112, the contact springs 72 extend at the other side of the member base 108 in a linear manner.

As shown in FIGS. 6 to 9, the plug modules 42, 44 are constructed symmetrically relative to a center plane 122 (see also FIG. 10) which extends in the direction of the signal path 48. The contact sections 20 are produced as contact blades 34 in both plug contact modules from two layers of sheet metal. In the contact blade 34, the layers are joined together and rest one on the other. In the socket contact 46, the layers are constructed with spacing from each other as contact members. At the other side of the contact section, the layers extend continuously as far as the printed circuit board contact section at the other end of the plug contact modules. In the extension section 92, the layers form lateral walls 94 which are connected to each other by means of a curved reinforcement member 98. In the shown embodiment, the extension section 92 has a U-shaped cross-section perpendicular to the signal path 48.

Figure 10:
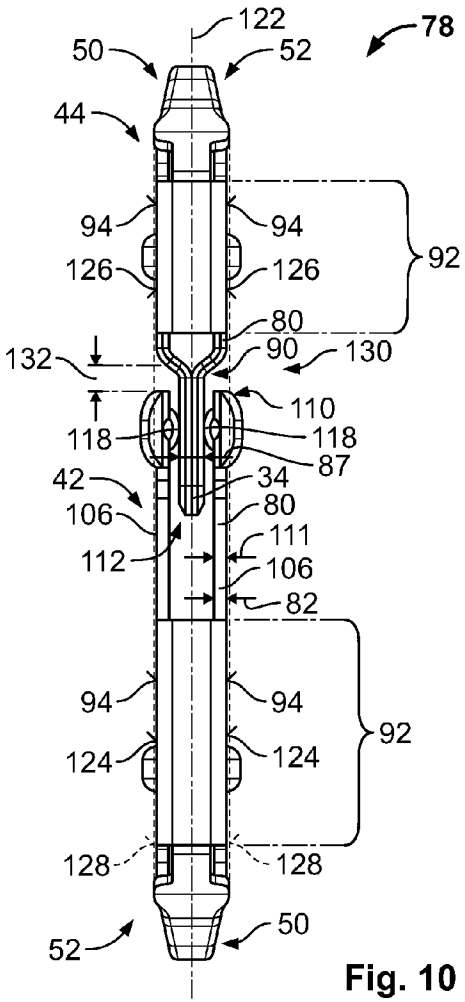
FIG. 10 is a schematic plan view of the plug contact modules of FIGS. 6 to 9.

If a plug contact module 42 and a plug contact module 44 are joined together with a plug contact arrangement 78 being formed, as shown in FIGS. 5 and 10.

If the contact blade 34 is located in the contact blade receiving member 112, the two contact members 106 extend parallel with each other. The contact members 106 are then located in a plane with the lateral walls 94 of the adjacent extension section 92 and also the extension section 92 of the other plug contact module. The mutual spacing of the lateral walls 94 of the extension section 92 of one plug contact module 44 further corresponds to the spacing of the lateral walls 94 of the other plug contact module 42. In this manner, the lateral outer faces 124 of one plug contact module 42 are in alignment with the lateral outer faces 126 of the other plug contact module 44. There is thus produced on the connecting sides of the plug contact arrangement that extend parallel with the movement direction an aligned outer layer 128 which extends almost continuously between the two printed circuit board contact sections 52 at the two opposing ends of the plug contact modules 42, 44. In the movement direction, the outer layer 128 formed by the lateral walls 94 and the contact members 106 has a constant height 89, 120 which extends continuously as far as the two printed circuit board contact sections 52 using the connection location between the contact blade 34 and the contact members 106. The material thickness of the lateral walls 94 and the contact members 106 is constant in the direction between the two printed circuit board contact sections since a metal sheet 8 of the same material thickness 82 is used for both plug contact modules 42, 44. At each location of the signal path 48 between the ends of the plug contact modules 42, 44, an identical material thickness is thus provided in the line cross-section.

The lateral outer layer 128 of the plug contact arrangement 78 is interrupted only by a gap 130 between the free end 110 of the contact members 106 and the shoulders 90 opposite these free ends 110. This interruption is tolerable with regard to the transmitting signal quality for frequencies in the gigahertz range as long as the spacing between the shoulder 90 and the free end 110 is not greater than 1/10, but not greater than 1/20 of the wavelength of the greatest frequency which is still intended to be transmitted in a reliable manner. Generally, this requirement is complied with when the spacing 132 between the free ends 110 of the contact members 106 and the shoulders 90 and the beginning of the extension section 92 which is adjacent to the shoulders 90 is less than 1 mm.

In shown embodiment, the plug contact arrangement 78 forms an almost continuous and linear waveguide between the two ends for frequencies in the gigahertz range. At the same time, the plug contact arrangement 78 is sufficiently robust owing to the production of the plug contact modules 42, 44 exclusively from a metal material, a punched metal sheet.

So that the contact members 106 extend parallel with each other when the contact blade is inserted into the contact blade receiving member 112 and that there is sufficient contact force provided on the contact faces 118 which also enables reliable contacting of a contaminated contact blade 34, the contact members 106 may extend slightly towards each other in the direction of the contact receiving member 112 before deflection. If the contact blade 34 is pushed into the contact blade receiving member 112, the contact members 106 are pressed in a direction away from each other. Owing to the curved configuration of the contact faces 118 of the contact members 106 there is produced at least a linear contact with high surface pressure, which produces a reliable electrically conductive connection which also functions when the contact blades 34 are contaminated.

Figure 11:
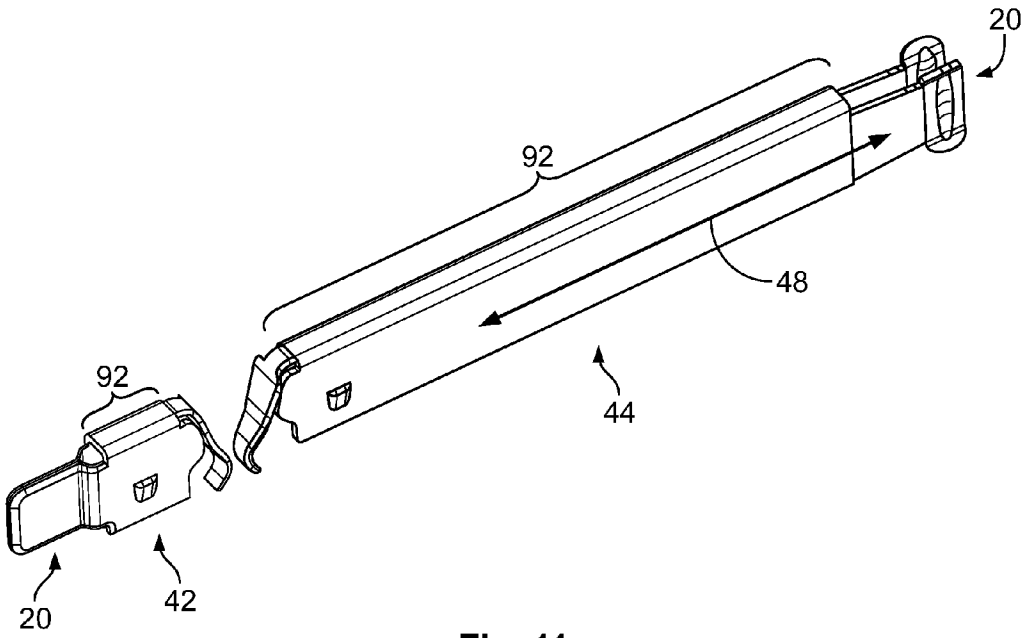
FIG. 11 is a top view of plug contact modules according to the invention.

Another aspect of the invention is shown in FIG. 11, in which the extension section 92 of one of the two plug contact modules (the plug contact module 44 is selected purely by way of example in this instance) is extended in the direction of the signal path 48. Of course, the extension section 92 of the other plug contact module 42 or the extension sections 92 of both plug contact modules 42, 44 can also be extended. Owing to the homogeneous construction of the extension section 92 which resembles that of a waveguide, it can be extended without losses of signal transmission quality. Owing to the extension of the extension section 92, the plug contact modules 42, 44 can be adapted to different depths 7 of input/output modules 1 (see FIG. 1). For example, the plug contact module 44 shown in FIG. 11 can be used in an input/output module 1 which has triple the width and in which the plug connector 16 has a corresponding depth 24.

This described construction leads to low impedance and good transmission of signal frequencies in the gigahertz range. Signal reflections owing to directional changes of the signal path cannot occur with this configuration. The construction of the plug contact modules 42, 44, which is based on that of a waveguide, is also continued in this region.

Regardless of whether the plug contact module 42, 44 is provided with a contact blade or with a socket contact, it is advantageous for a printed circuit board contact section to be provided for contacting a printed circuit board or another electrical and/or electronic component at the end of the signal path opposite the contact section. This arrangement of the printed circuit board contact section leads to a linear signal path between a contact section and printed circuit board contact section and not to a signal path which is bent through 90°, as is the case, for example, in the plug contact module of EP1173902 B1 with the soldering lugs which protrude perpendicularly from the contact members and the contact blade.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A plug contact module, comprising:
- a base member;
- a contact spring extending from the base member and having a resilient articulation section; and
- a contact section extending from the base member and having a pair of contact members extending linearly and parallel with respect to each other and defining a contact blade receiving member there between, each of the pair of contact members having a contact face extending parallel with the contact spring into the contact blade receiving member and a spacing corresponding to a material thicknesses of each of the pair of contact members.

2. The plug contact module according to claim 1, further comprising a stop extending from the base member and positioned between the contact spring and the base member.

3. The plug contact module according to claim 2, wherein the contact face is curved inward toward the contact blade receiving member.

4. The plug contact module according to claim 3, wherein the contact face extends over at least a height of the contact spring.

5. The plug contact module according to claim 1, wherein the base member has a length at least equal to a length of the contact section.

6. The plug contact module according to claim 1, further comprising a printed circuit board contact section disposed at one end of the base member opposite the contact section.

7. The plug contact module according to claim 6, wherein the printed circuit board contact section includes a contact spring and a stop positioned in a recess between the contact spring and the base member.

8. The plug contact module according to claim 7, wherein the contact spring is resiliently biased away from the contact section.

9. The plug contact module according to claim 1, further comprising a receiving edge extending from the contact face.

10. The plug contact module according to claim 9, wherein the receiving edge extends way from the contact blade receiving member.

11. A plug contact module, comprising:
- a plurality of lateral walls extending parallel to each other;
- a reinforcement member connecting the plurality of lateral walls;
- a contact section extending from the plurality of lateral walls and having a contact blade; and
- a printed circuit board contact section disposed at one end of the reinforcement member opposite the contact section and including a contact spring and a stop positioned in a recess between the contact spring and the plurality of lateral walls.

12. The plug contact module according to claim 11, wherein a thickness of the contact blade is equal to a sum of thicknesses of the plurality of lateral walls.

13. The plug contact module according to claim 11, wherein the contact spring is resiliently biased away from the contact section.

14. The plug contact module according to claim 11, further comprising a chamfer disposed along both sides of the contact blade.

15. A plug contact arrangement, comprising
- a plug socket module having:
  - a base member;
  - a contact spring extending from the base member and having a resilient articulation section; and
  - a socket contact section connected to the base member and having a pair of contact members extending linearly and parallel with respect to each other and defining a contact blade receiving member there between, each of the pair of contact members having a contact face extending parallel with the contact spring into the contact blade receiving member; and
- a plug contact module securable to the plug socket module and having:
  - a plurality of lateral walls extending parallel to each other;
  - a reinforcement member connecting the plurality of lateral walls; and
  - a contact section extending from the plurality of lateral walls and having a contact blade having opposite the contact faces to engage the pair of contact members.

16. A plug contact module, comprising:
- a base member;
- a contact spring extending from the base member and having a resilient articulation section; and
- a contact section extending from the base member and having a pair of contact members extending linearly and parallel with respect to each other, extending orthogonally with respect to the contact spring, and defining a contact blade receiving member there between, each of the pair of contact members having a contact face extending into the contact blade receiving member and a spacing corresponding to a material thicknesses of each of the pair of contact members.

* * * * *